US006443917B1

(12) United States Patent
Canto

(10) Patent No.: US 6,443,917 B1
(45) Date of Patent: Sep. 3, 2002

(54) MASSAGING DEVICE FOR A REST ARMCHAIR

(75) Inventor: Enrique Canto, Alicante (ES)

(73) Assignee: Eurokeyton, S. A., Alicante (ES)

( * ) Notice: Subject to any disclaimer, the term of this patent is extended or adjusted under 35 U.S.C. 154(b) by 0 days.

(21) Appl. No.: 09/446,178

(22) PCT Filed: Jun. 16, 1998

(86) PCT No.: PCT/ES98/00172

§ 371 (c)(1),
(2), (4) Date: May 3, 2000

(87) PCT Pub. No.: WO98/57611

PCT Pub. Date: Dec. 23, 1998

(30) Foreign Application Priority Data

Jun. 17, 1997 (ES) ..... 90701318

(51) Int. Cl.[7] ..... A61H 19/00

(52) U.S. Cl. ..... 601/99; 601/98; 601/101; 601/103

(58) Field of Search ..... 601/107, 108, 601/111, 115, 116, 122, 126, 128, 130, 134, 97, 98, 99, 101, 102, 103, 89, 90, 93, 94

(56) References Cited

U.S. PATENT DOCUMENTS

| | | | | | |
|---|---|---|---|---|---|
| 3,322,116 A | | | 5/1967 | Murphy | |
| 4,009,710 A | | | 3/1977 | Inada | |
| 4,718,408 A | | | 1/1988 | Barreiro | |
| 5,020,518 A | | | 6/1991 | Spears et al. | |
| 5,052,376 A | | | 10/1991 | Yamasaki | |
| 5,462,516 A | | | 10/1995 | Anderson | |
| 6,083,181 A | | * | 7/2000 | Marcantoni | 601/99 |
| 6,200,282 B1 | | * | 3/2001 | Furuie et al. | 601/98 |
| 6,224,563 B1 | | * | 5/2001 | Nonoue et al. | 601/99 |

FOREIGN PATENT DOCUMENTS

| | | | | |
|---|---|---|---|---|
| JP | 40 6-105878 | * | 4/1994 | A61H/7/00 |
| WO | 96/01610 | | 1/1996 | |

* cited by examiner

*Primary Examiner*—Michael A. Brown
*Assistant Examiner*—Benjamin K. Koo

(57) ABSTRACT

The device is intended to make massages of the left side of the user's back independently from the right side of the user's back, with the added possibility of regulating the intensity of such massage also independently in the modes of kneading, tapping vertical displacement. It has four independent motors (1, 3, 10 and 12) governed by a control unit (18) and which transmit the rotation to respective excentric (2, 4, 11 and 14) or centered (22) axes which are connected to conventional massage applicating elements (5 and 14). Said axes (2, 4, 11 and 14) or (22) include sensors (17) which inform on the angular position. The device is also provided with two motors (9 and 16) for the vertical displacement which are also connected to the control unit (18).

13 Claims, 17 Drawing Sheets

MASSAGING DEVICE FOR A REST ARMCHAIR

DESCRIPTION

OBJECT OF THE INVENTION

This invention, as stated in this descriptive report, refers to a massage device for a lounge chair the aim of which is to permit totally independent and combined massages for the left and right areas of the back, both in the kneading and clapping modes and in the moving of the elements that provide the massage; four motors governed by a control unit being included for this instead of the two typical motors in conventional massage chairs, as well as two motors employed for vertical movement also connected to the control unit.

DESCRIPTION OF THE STATUS OF THE TECHNIQUE

These are well-known massage chairs which provide kneading and clapping massages employing two motors which transmit movement to certain dependent shafts and to certain massage elements, all of this in such a way that if the turning of these motors is produced in one direction a kneading massage is established on both sides of the user's back, while if the turning is produced in the opposite direction a clapping massage is produced on both sides of the back.

Thus, the U.S. Pat. Nos. 5,052,376, 5,137,016 and 5,460,598 include massage-providing devices for armchairs which have two eccentric and inclined shafts which connect with the massage-providing devices themselves. These shafts are moved by motors in such a way that the turning of the motors in one direction causes one type of massage, while turning in the opposite direction determines the other type of massage.

On the other hand, the publications of applications for patents numbers JP-A-7-323057, WO-A-97/37627, JP-A-02-279157, JP-A-02-172466, JP-A-9-75416, PCT/DE97/00873 and JP-A-9-38167 are well known. All these applications refer to massage devices, but none of these has four independent motors which can make the right and left massage sides independent, as in the case of the invention with which we are concerned. Furthermore, neither do they allow massages to be given to the left and right independently.

Finally, these devices cannot, obviously, graduate the intensity or the speed of the massage to the left side with respect to the right side, or vice versa in order for these massages to be given with different intensities or speeds in terms of the tastes or therapeutic needs of the user.

DESCRIPTION

In order to achieve these objectives and avoid the inconveniences indicated in the sections above, the invention consists of a massage device for a lounge chair which has four shafts, two of these being connected to an element for applying the massage to the left side of the user's back, while the other two are connected to an element for applying the massage to the right side of the user's back.

These shafts are joined by different means to four electric motors, one for governing each shaft, generating kneading massages and clapping massages independently. Two of the four motors are located for the left side of the user's back and another two for the right side, each of these having an independent function, one left motor for kneading, which transmits a rotating movement to the left shaft for kneading, one left motor for clapping which transmits the rotating movement to the shaft for clapping on the left, one right motor for kneading which transmits the rotating movement to the right shaft for kneading and a right motor for clapping which transmits the rotating movement to the shaft for clapping on the left.

The generating of the kneading and clapping massages is performed via the two elements for applying the massage moved by the aforementioned shafts, each element for applying the massage being joined to two shafts, the kneading shaft in the upper part and the clapping shaft in the lower part. These elements for applying the massage have massage wheels at those points intended to perform the massage on the user's back.

The massage device that is the object of this invention, has different massage possibilities such as independent massage means for the left and right sides of the user, both for kneading and for clapping, with the possibility of graduating the intensity or speed on each side in an independent manner; synchronised or de-synchronised massage on both sides of the user's back; variation in the direction of the kneading massage in the left area; variation in the direction of the kneading massage in the right area;, lateral multi-positioning in vertical massaging in an independent manner for the left and right areas of the back; and in-depth multi-positioning in vertical massaging in an independent manner for the left and right areas of the back.

In order to achieve the different types of massage, the four independent motors are connected to a control unit, which will govern the movement of same.

The system for raising the massage elements depends on the location of the four massage motors. These can be grouped two by two, the two motors with the task of the kneading and clapping massages on the left side and the other two kneading and clapping motors on the right side, joined in pairs to two independent structures, one on the left side and the other on the right side, in such a way that the ascent and descent of the motors is performed in an independent manner. By means of this system, massage at different levels on both sides, the left and right, of the back is achieved. The other option is for the four massage motors to be fixed in the same structure in such a way that raising them occurs together, that is to say, in this case there cannot be independent massage at a different level for the left side and the right side of the back.

In the first case, in which the motors are fixed to two independent structures for each side of the back, to determine the vertical location of the four motors, two motors connected to the aforementioned control unit exist, one of these vertically controls the motors with the task of providing the different types of massage on the left side of the user's back and the other motor has the task of controlling the vertical displacement of the motors located on the right side. Displacement is performed not only for the motors but for the entire massage system in general, including the shafts on either side.

The vertical displacement system, with the massage motors grouped two by two, can be of different types, mainly using spindles, one spindle for the vertical displacement of the two motors located on the left side, one for kneading and the another for clapping, and another spindle for controlling the height of the device on the right side. Each spindle will be controlled by one of the two vertical displacement motors.

Another means for vertical displacement in the case of the motors being grouped two by two consists of a rack and pinion wheel, formed by four sides of the rack, one on each side of each structure in which the motors are grouped, their height being controlled by the vertical displacement motors which each have cogwheels at their ends which engage with the sides of the rack-wheel. This mechanism can be substituted by a similar one but instead of using rack sides, chains are used with pulleys at the ends.

In the case of the four massage motors being joined to a single structure, the displacement motors will be substituted by a single one and any of the means described above may be employed but with the corresponding modifications.

In order to control the situation of the four motors referred to previously, positioning sensors are included connected to a microprocessor in the control unit and in this way the position of the rotors is known at all times, thus making for greater and better control, greater synchronisation in the movements of the independent shafts and therefore the type of massage possible. These sensors have the task of controlling the turning angle of the different shafts of which the device is composed and transmitting this to the microprocessor. This same system is employed to control the vertical location of the massage motors.

The rotating movement of the motors can be transmitted to the shafts in which the elements for applying the massage are located in different ways. The shafts for transmitting movement can be eccentric or inclined and thus generate the movement required in the elements for applying the massage, but the movement is communicated from the motors via different systems. The first system employs traditional reducing wheels in the four massage motors, in which helicoidal wheels are used for the transmission of the rotating movement from the motor shaft to the eccentric inclined shaft. Another type of transmission is that which uses belts and pulleys as transmitters of movement from the motor to the shafts. This type of transmission is carried out with two pulleys, one connected to the motor shaft and the other to the massage shaft where the elements for applying the massage are located, communication between the two pulleys being by pulley. Another type of transmission employed consists of using direct transmission by the rotors of the motors, this type of rotating movement being applied directly to the eccentric shafts. In the above cases, the shafts connected with the elements for applying the massage project to the outside of the structure, the motors being located in the interior part of same.

In these types of transmission of the movement of the motors to the eccentric shafts, the latter can be substituted by centred shafts, that is to say, by shafts without any type of eccentricity, projecting towards the interior of the structure leaving the motors on the outside of same. Each pair of centred shafts has a central support bearing which is connected to these two shafts in such a way that the two shafts give mutual support but their turning movements remain independent. In order to achieve the same movements as in the eccentric shafts, an eccentric transmission element is included formed by a bush linked to the massage shaft but with its turning shaft displaced with respect to the massage shaft, achieving the eccentric movement acquired previously with the inclined eccentric shafts. The corresponding massage application element is connected to these bushes.

Partial functioning of the chair is achieved by means of the four independent motors, maintaining many of their services even when there is a fault in one of the motors.

These configurations described allow various types of massage to be obtained in a new and advantageous manner, but the main combinable massages are the kneading and clapping massages together with independence in the massage on the left and right sides. The kneading massage is performed by the kneading motor and shaft generating a movement in the massage application elements which is almost circular due to the eccentricity and inclination of the shafts or the inclined eccentric bushes located over these, while the clapping massage consists of a massage, as the word itself indicates, in which the elements for applying the massage penetrate the back of the chair and therefore the user's back due to the eccentricity of the shafts or the eccentricity of the bushes located over these. The different types of massage obtained by this device are the following:

The most important and relevant thing that this device offers is that it permits the intensity or speed of the left side to be independent of the right side or vice versa, in terms of the need or therapeutic prescription of the user. For this, the control unit will be used to regulate the balance of the intensities or speeds.

Individual synchronised kneading massage in both directions.

By starting the two right and left kneading motors, massage is achieved in unison, on both sides of the back. The turning direction of the two right and left kneading motors can be reversed individually, which will obtain:

Right and left kneading from inside outwards.

Right and left kneading from inside outwards.

Right kneading from inside to out and left from outside inwards.

Right kneading from outside inwards and left kneading from inside outwards.

The kneading movements from inside outwards and vice versa mean that the circumference drawn by the elements applying the massage is in the direction of the hands of a clock and vice versa.

Individual synchronised clapping massage.

This type of massage is achieved by starting the left and right clapping motors in unison, by which action a message is given to both sides of the back. In this type of massage, a change in the turning direction of the motor has no meaning as it does not change the type of message obtained.

Kneading massage in both directions and clapping simultaneously.

By starting the left and right kneading motors, together with the left and right clapping motors, two types of massage are achieved at the same time on both sides of the back.

If the turning direction of one or of the two kneading motors is changed, this massage will be given either from inside outwards or vice versa, on one or both sides of the back, in terms of the requirements of the user receiving the massage.

Individual kneading massage on the right side, in both directions.

This message is achieved by starting the right kneading motor, in one or the other direction, to achieve a massage from inside outwards or vice versa.

Individual kneading message on the left side, in both directions.

This massage is achieved by starting the left kneading motor, in one or the other direction, to achieve a massage from inside outwards or vice versa.

Individual clapping massage on the right side, in both directions.

In this case, the massage is achieved by only starting the right clapping motor.

Individual clapping massage on the left side, in both directions.

In this case, the massage is achieved on the side required by only starting the left clapping motor.

Kneading massage on the right side, in both directions and clapping massage on the left.

This combination of massages is achieved by starting the right kneading motor and the left clapping motor and, at the same time, we can select the turning direction of the kneading motor, for the massage to be from the inside outwards or vice versa.

Kneading massage on the left side, in both directions, and clapping massage on the right.

This combination is achieved by starting the left kneading motor and the right clapping motor at the same time. Also the turning direction of the kneading motor can be selected at the same time, for this massage to be either from the inside outwards or vice versa.

Individual de-synchronised kneading massage, in both directions.

This effect is achieved by using the positioning sensor located in each of the kneading shafts which determine the position of each of the two shafts, in this way, a choice may be made of whether the right and left kneading shafts turn with a lack of synchronisation of a particular number of degrees, determined by the separation in the plate of the positioning sensor.

At the same time that the de-synchronised massage is obtained at that number of degrees, the turning direction of the motors can be changed either in unison or separately, by which the massage will be performed from inside outwards or vice versa.

Individual de-synchronised clapping massage, in both directions.

The de-synchronising of the clapping massage is achieved by locating a sensor which controls the position of the shaft in each one of the clapping shafts. In this way the left and right clapping shafts can be made to turn with a de-synchronisation of a particular number of degrees, determined by the separation given in the plate of the positioning sensor.

Various opening options in the vertical massage, with or without clapping.

The distance, or opening, between the massage wheels in the two elements for applying the massage is controlled by means of the position sensors that control the turning of the right and left kneading shafts, by means of which a multitude of different openings for separation between the right and left massage wheels are achieved thanks to the eccentricity in the kneading shafts. In this way, vertical massage can be performed with different openings, that is to say, by vertically displacing the massage motors and maintaining the distance between the left and right massage wheels constant, although variable if so wished by the user. If at the same time that this massage is performed, the clapping shaft is activated, the clapping massage will be performed with a particular separation between the wheels.

Various pressure options on the user's back in vertical massage, with or without kneading.

The depth of the pressure on the shoulders of the users from the massage wheels, a pressure possible due to the eccentricity existing in the clapping shafts, is controlled by means of the positioning sensors that control the right and left clapping motors. In this way, vertical massage can be performed with a pressure to be determined in terms of the reading made by the positioning sensor on the shaft. If, in this way, vertical massage is started, by activating the vertical displacement motors, the massage will be performed with the pressure determined on the user's back. This type of massage, as with all the previous ones, can be done totally independently on one or the other side of the back, subjecting one to clapping with a certain depth and the other to hardly any. If at the same time that this massage is performed, the kneading massage is activated either on one or both sides, and in one or the other direction, the massage combination required will be achieved.

In view of this description, the various types of massage that can be achieved using this massage device for a lounge chair are almost unlimited due to the total independence of the two sides of the back, it being possible to subject the two sides to completely different massages, with different depths, with a different speed and intensity and at a different height. Due to these characteristics, the therapeutic advantages of this device are enormous permitting treatment of all types of discomfort and maladies of the back with a major guarantee of success.

DESCRIPTION OF THE FIGURES

In order to facilitate comprehension of the massage device for the lounge chair, eighteen figures are included in this application for a patent the aim of which is a better comprehension of the foundations on which the invention with which we are concerned is based and also a better understanding of the description of a preferential form of operating, taking into account that the nature of the figures is illustrative and not limiting.

DESCRIPTION OF THE PREFERABLE MEANS OF OPERATING

Figure 1:
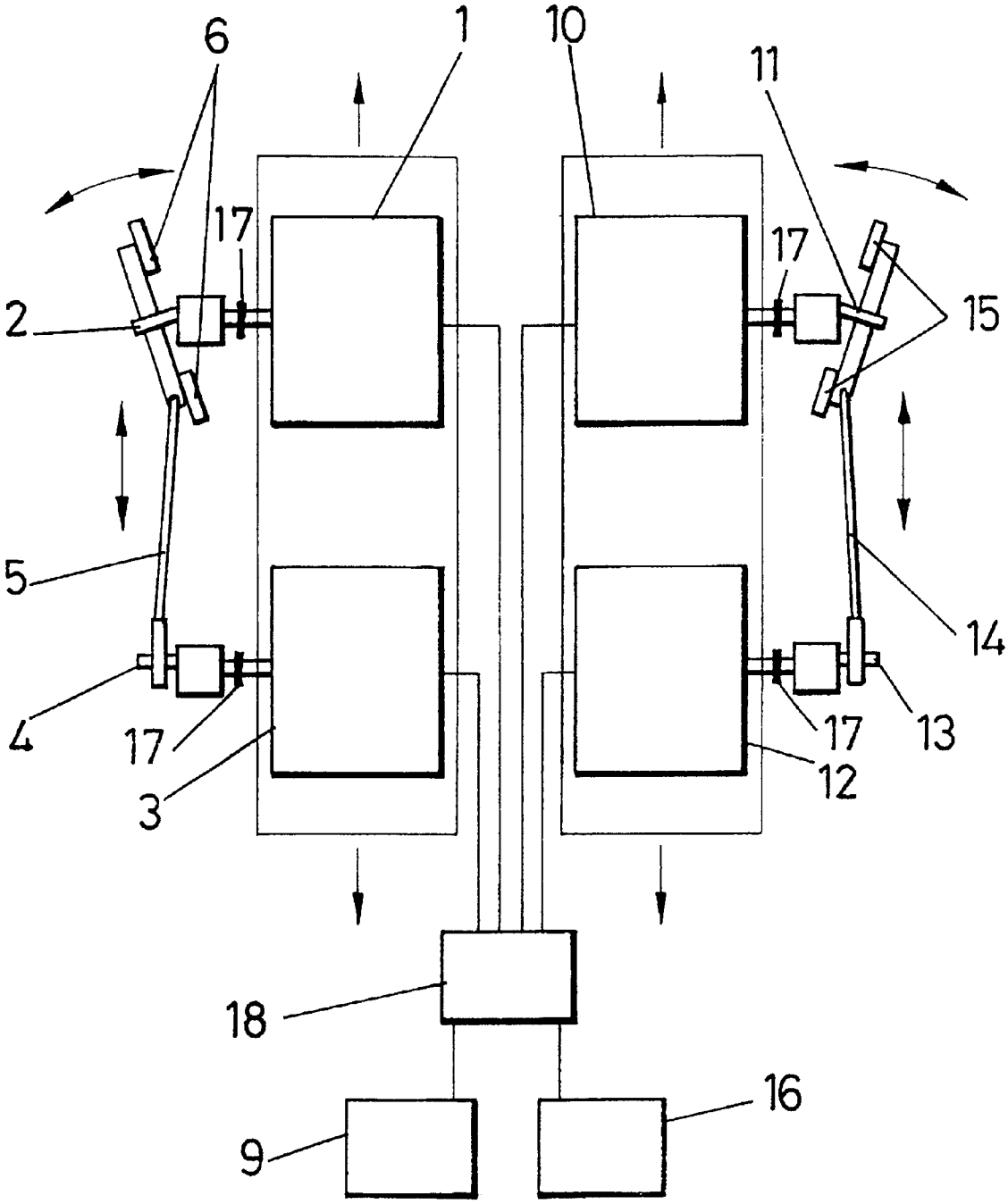
FIG. 1, shows schematically a block diagram of a massage device for a lounge chair carried out according to this invention.
Figure 2:
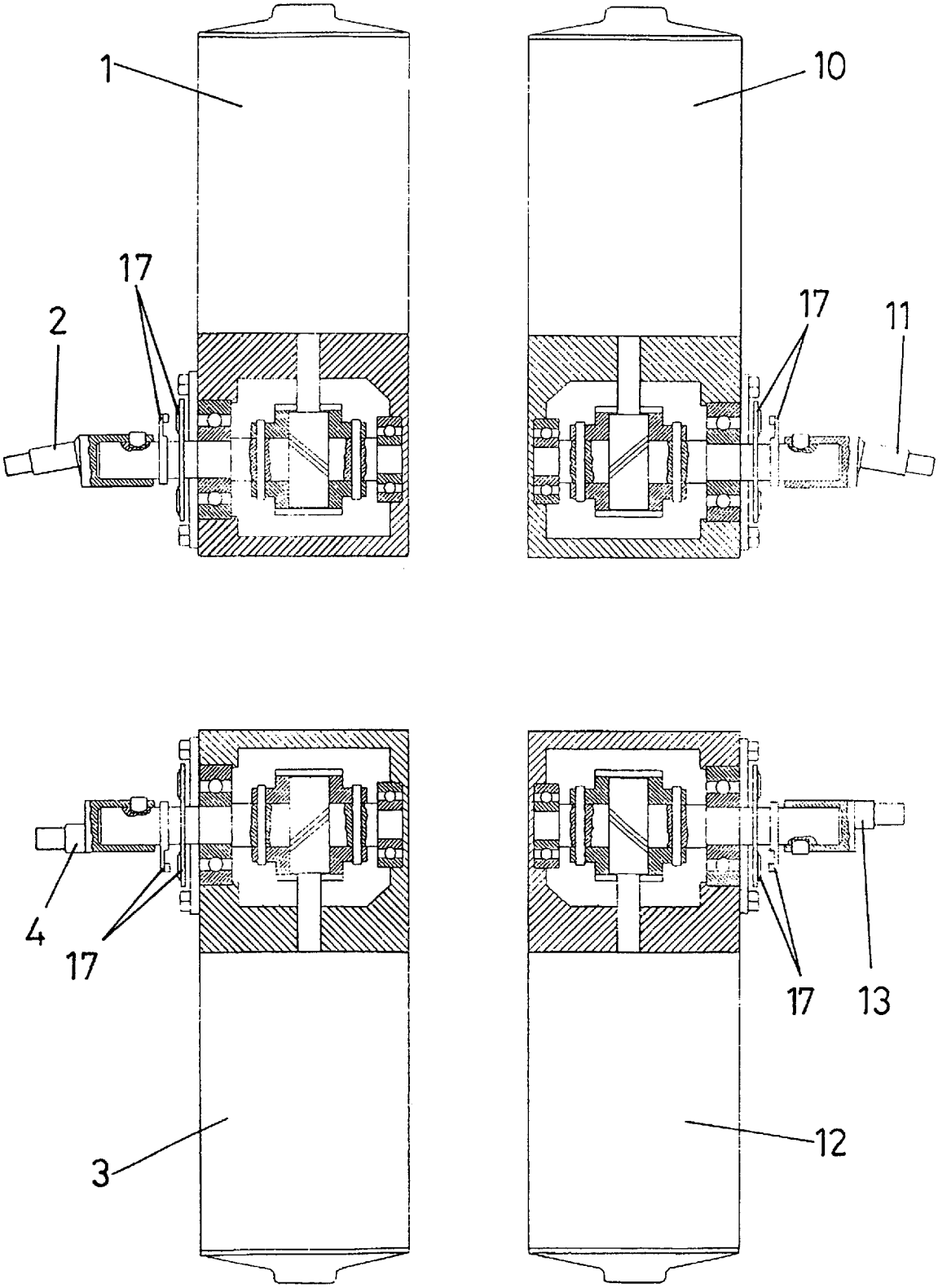
FIG. 2, shows a front view with partial sections of the four kneading and clapping motors used by a massage device for a lounge chair according to this invention.
Figure 3:
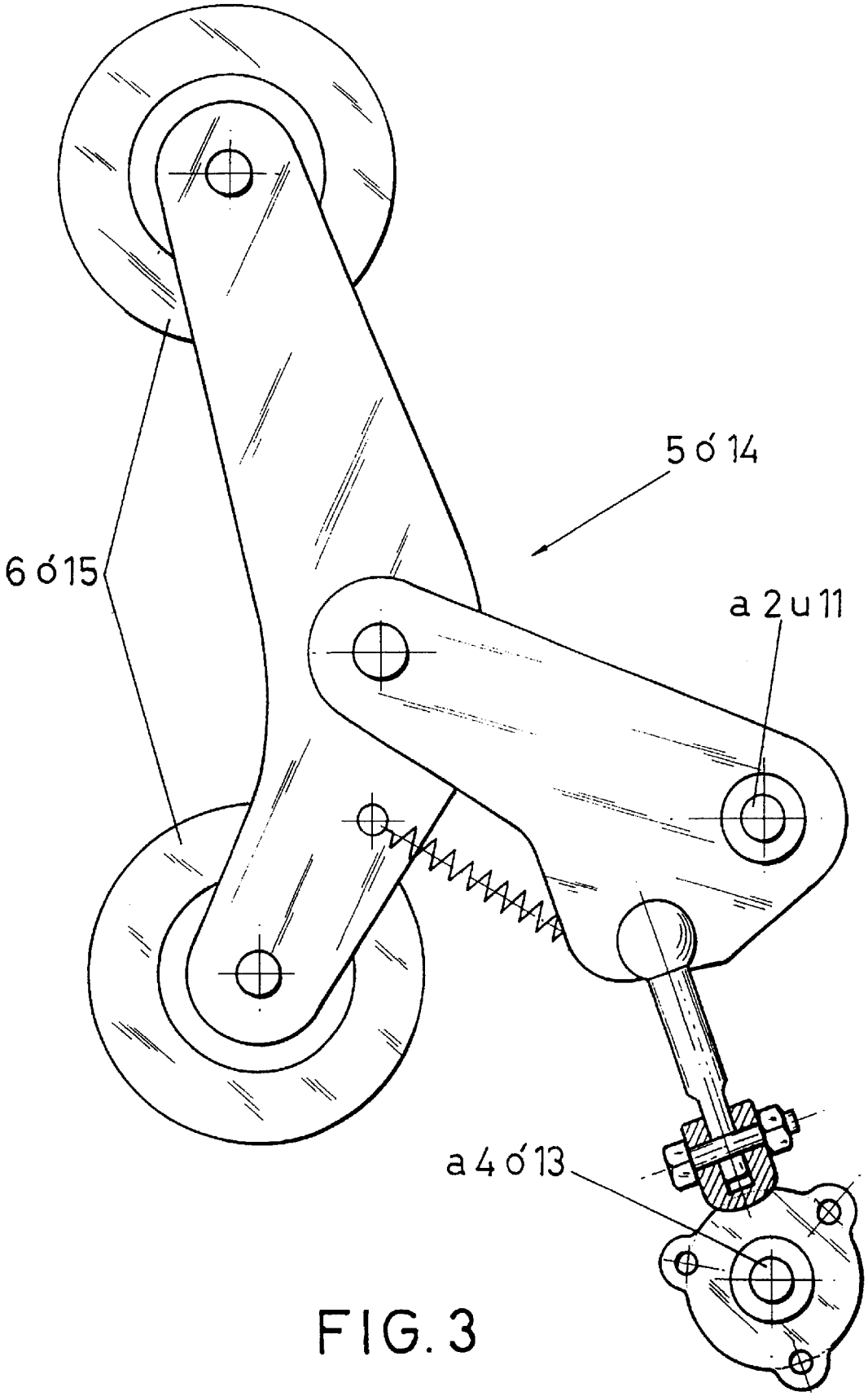
FIG. 3, shows a view in profile of a conventional element for applying the massage which is connected to two of the motors referred to in the previous figure.
Figure 4:
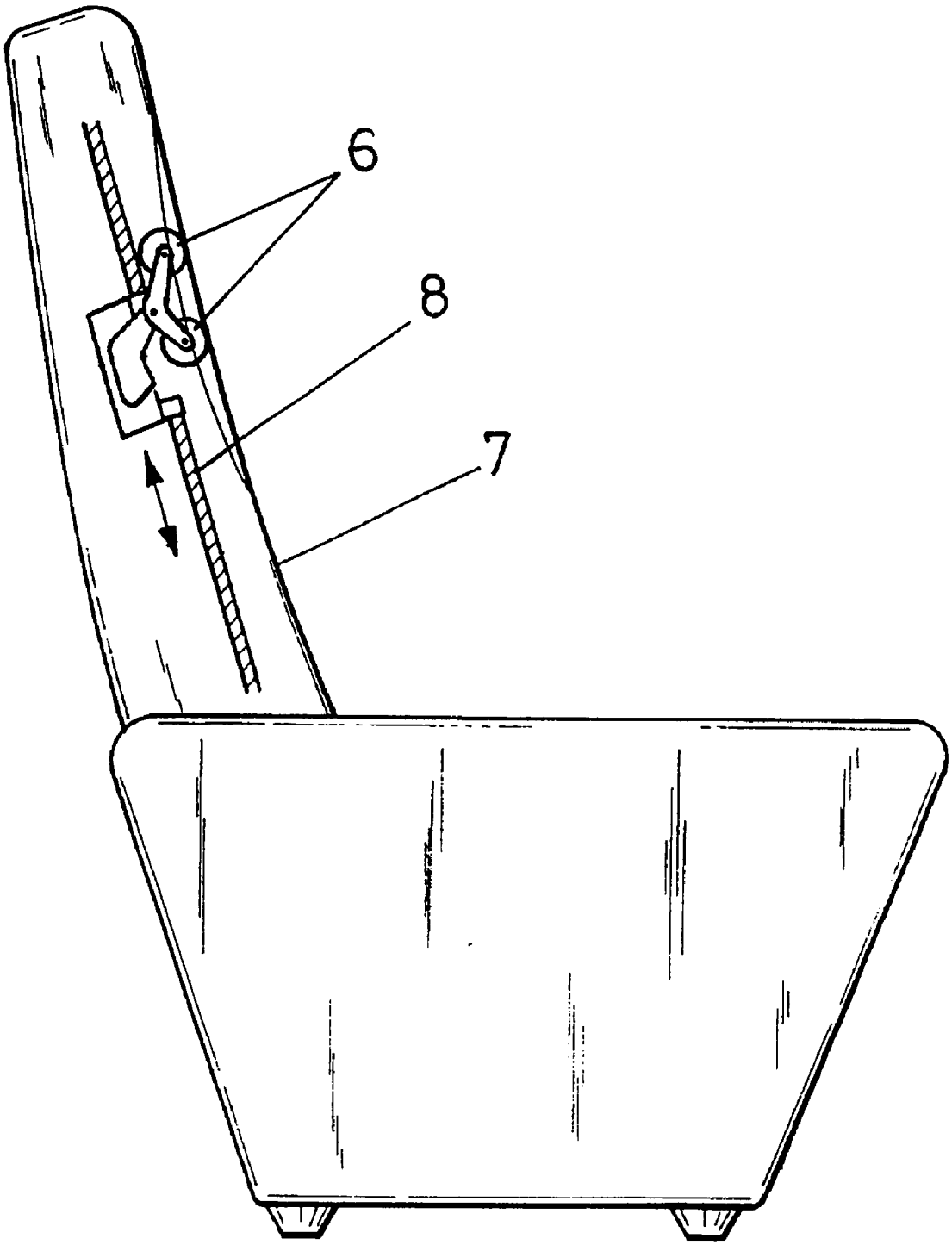
FIG. 4, shows, very schematically, the massage device located in the corresponding chair, showing a view in profile and sections of the said chair.
Figure 5:
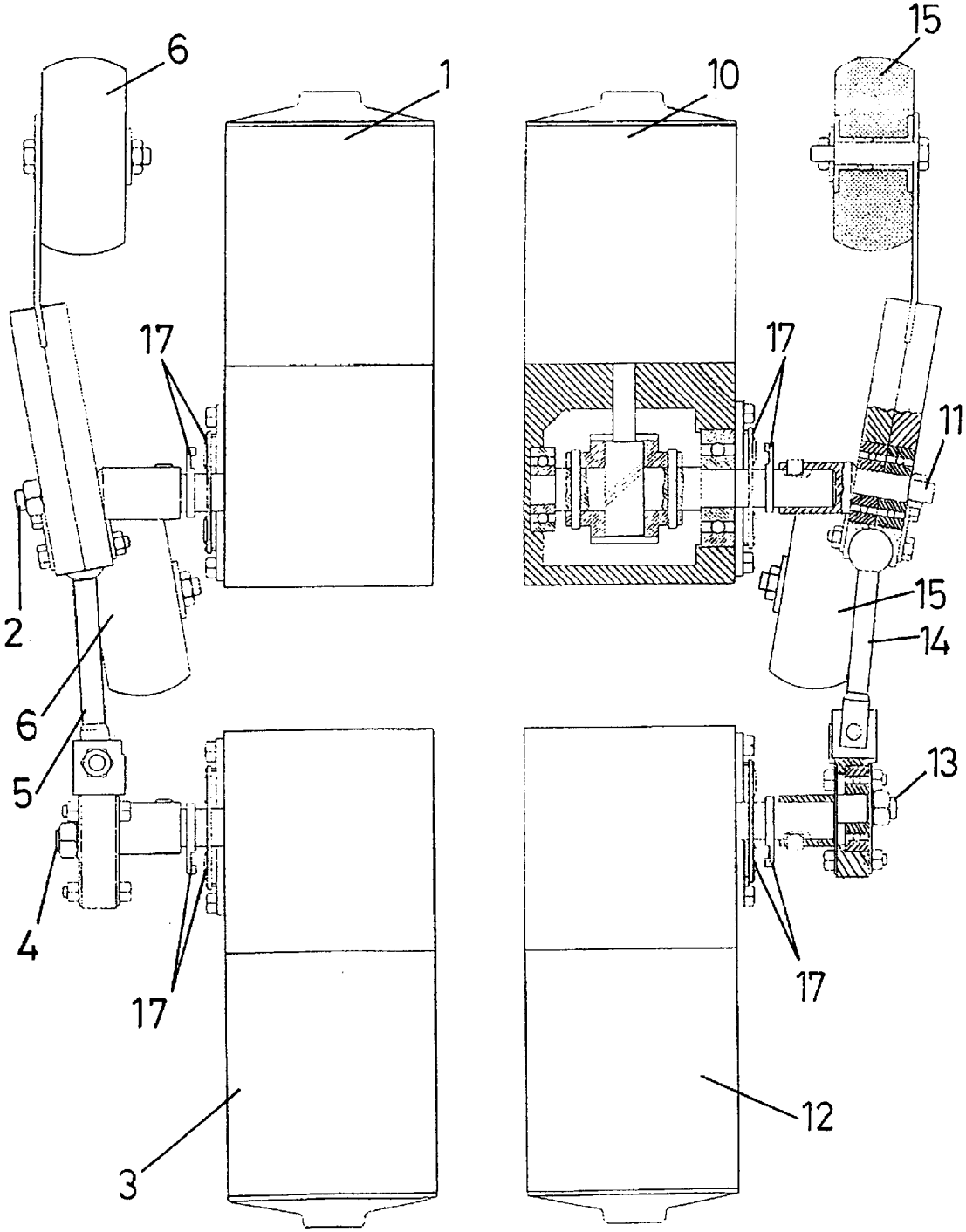
FIG. 5 shows a front view of the same four motors referred to in FIG. 2, but with two conventional elements for applying the massage connected to them, similar to that referred to in FIG. 3.
Figure 6:
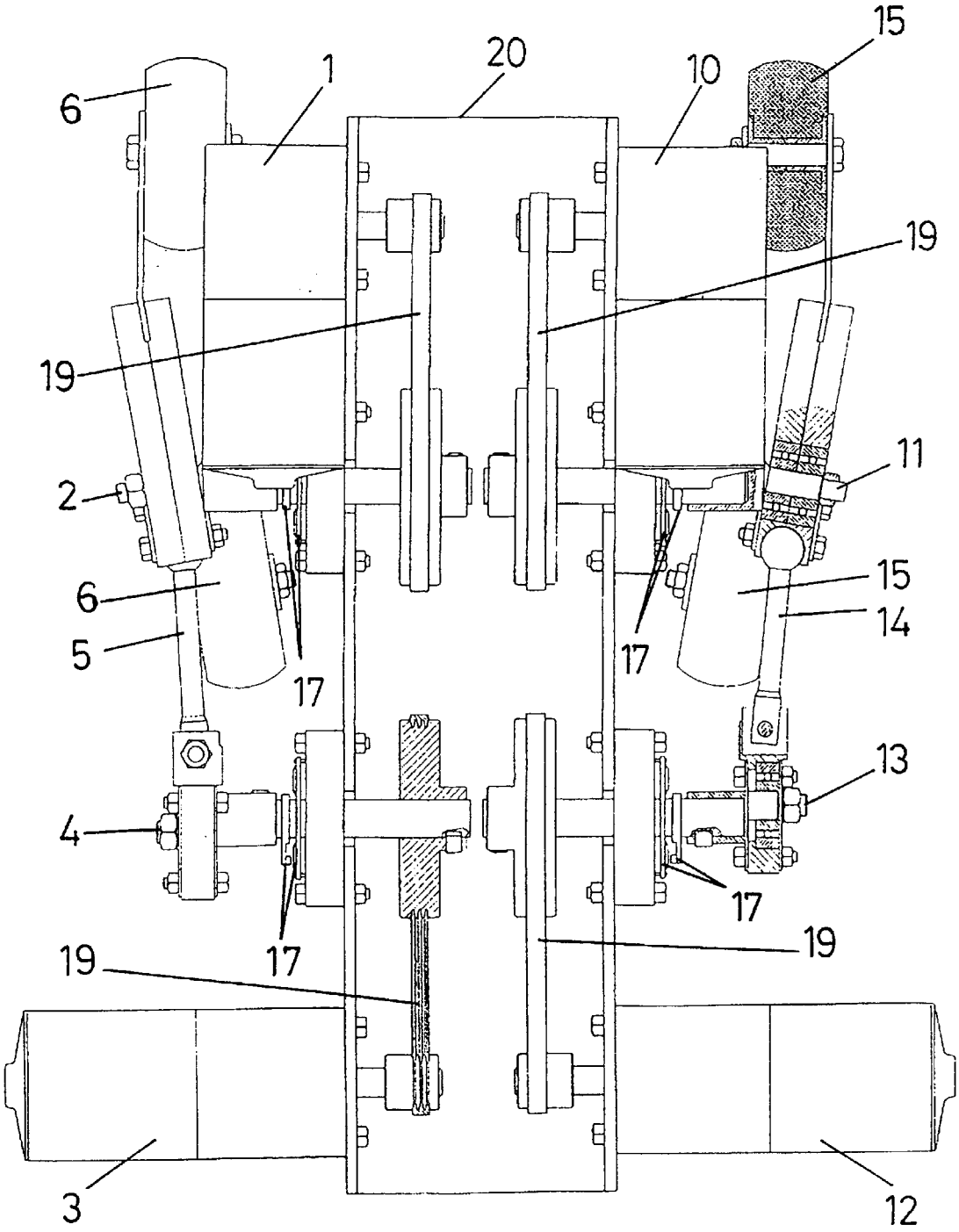
FIG. 6, shows a variation of the invention similar to the previous one but with transmission by pulleys instead of reducers and the four motors grouped in a common housing instead of being independent.
Figure 7:
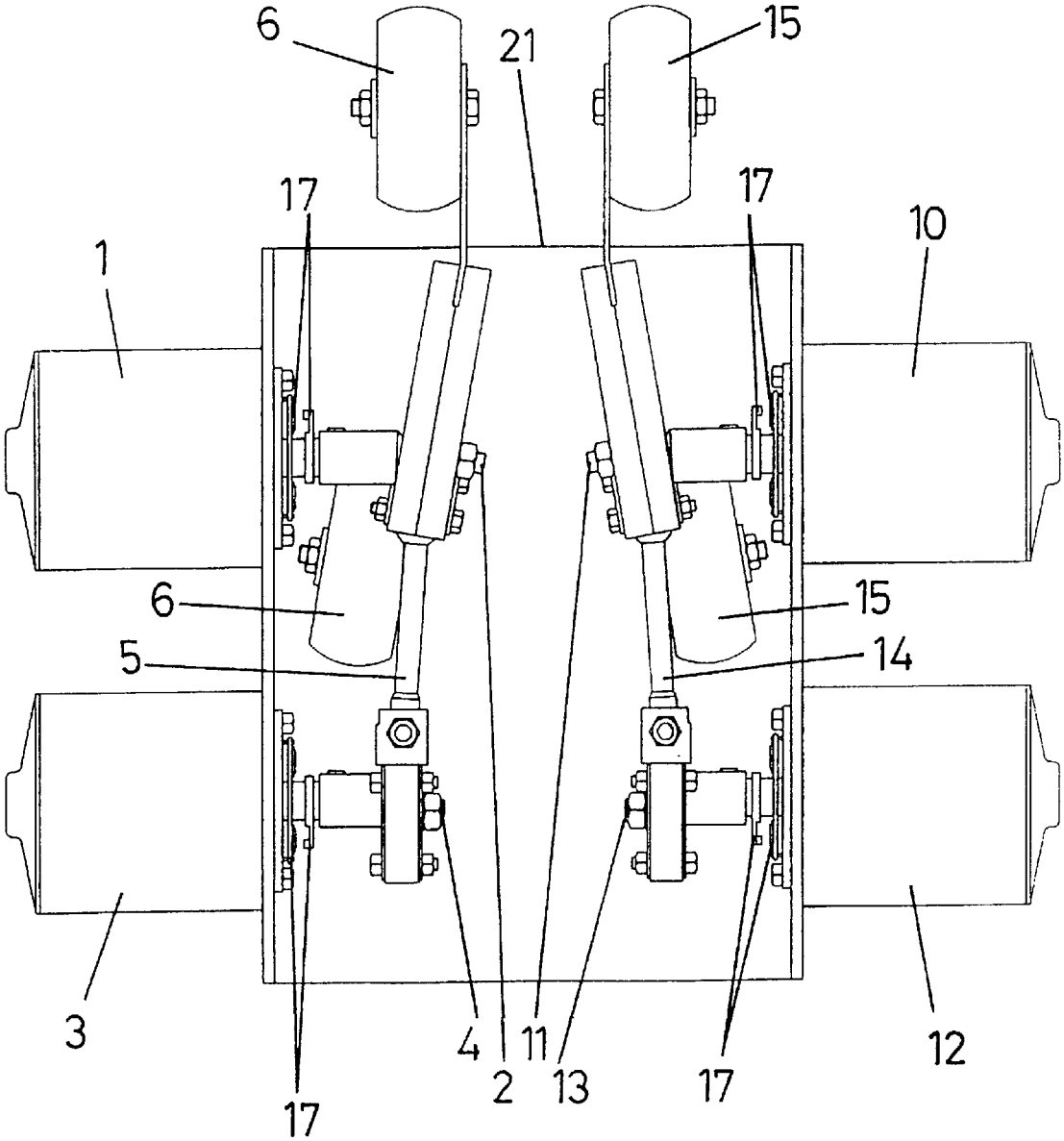
FIG. 7, shows another variation of the invention similar to FIG. 6 above but with transmission directly by the rotors of the motors to the massage shafts.

A description of six examples of the invention with which we are concerned, a massage device for a lounge chair, is given below, with reference to the numbering used in the figures.

Thus, the first example of the massage device for a lounge chair has a left kneading motor 1 which, by means of reducers, transmits the movement to a left eccentric and inclined shaft 2 and a left clapping motor 3 which by means of reducers transmits the movement to a left eccentric shaft 4.

The shafts 2 and 4 connect with a conventional element for applying the massage 5 whose wheels 6 are those which from the interior of the corresponding chair 7 are applied to the left part of the user's back. In turn, all the elements 1 to 6 can be displaced by a spindle 28 by means of a left displacement motor 9.

In the same way, the device in this first example for the right side, has a right kneading motor 10 which by means of the right clapping motor 12 and reducers transmits the movement to a right eccentric shaft 13.

The shafts 11 and 13 connect with a conventional massage element 14 whose wheels 15, with those from the interior of the corresponding chair 7, are applied to the right part of the user's back.

All these elements 10 to 15 can be displaced in a block by a spindle (8) by means of a right displacement motor (16).

Furthermore, the four motors 1, 3, 10, and 12 have their respective magnetic sensors 17 connected to a microprocessor (not shown in the figures for the greater clarity of same) which permit the situation of the angles of the shafts 2, 4, 11 and 13 to be known with exactitude.

The four kneading and clapping motors (1, 3, 10 y 12), the displacement motors (9 and 16) and the aforementioned microprocessor are connected to an electronic control unit 18 which governs the activating of each of the six motors in terms of the orders received, according to the situation of the aforementioned shafts 2, 4, 11 and 13 and by means of the necessary programmes.

Thus, according to the motors activated and the turning direction given to them, all the types of massage described in the section "DESCRIPTION OF THE INVENTION", are possible, these are:

- Individual synchronised kneading massage in both directions (motors 1 and 10)
- Kneading massage in both directions and clapping at the same time (motors 1, 3, 10 and 12).
- Individual kneading massage on the left side, in both directions (motor 1).
- Individual kneading massage on the right side, in both directions (motor 10).
- Individual clapping massage on the right side (motor 12).
- Individual clapping massage on the left side (motor 3).
- Kneading massage on the right side in both directions and clapping on the left side (motors 10 and 3).
- Kneading massage on the left side in both directions and clapping on the right side (motors 1 and 12).
- Individual de-synchronised kneading massage in both directions (sensors 17 of motors 1 and 10).
- Individual de-synchronised clapping massage (sensors 17 of motors 3 and 12).
- Multiple options for distancing between the vertical massage wheels, with or without clapping (sensors 17 of the motors 1 and 10).
- Multiple pressure options in the vertical massaging, with or without kneading (sensors 17 of the motors 3 and 12).

The second example for operating is similar to the above, with the differences that the transmission of the corresponding motors 1, 3, 10 and 12 is by means of belts and pulleys 19 instead of reducers and that these four motors 1, 3, 10 and 12 are fixed in a common housing 20.

Logically, in this alone there is a spindle with a displacement motor that has not been shown in the figures as they are the same as elements 8 and 16 in the previous example.

This second example has the same massage possibilities as those indicated above for the first example, although here obviously it is not possible to make the displacement of the left motors 1 and 3 and of the right motors 10 and 12 independent as they are mounted in a common housing 20; although, on the other hand, there would be no technical reason why it would not be possible to part or separate the housing 20 into two halves, one for motors 1 and 3 and another for motors 10 and 12 and make the displacements using two independent spindles and two motors, the same as motors 9 and 16 in the previous example.

Another alternative to the motor-shaft type of transmission and taking into account that this concept is not the object of the patent, is shown in the third example of operating and consists of employing direct transmission by the rotors of motors 1, 3, 10 and 12 which are mounted in a common housing 21 and all that is said for the second example can be extended to this third example of operating, although it is possible to choose mounting in independent housings.

Logically, it would be possible to use any type of transmission existing or which may be developed in the future and which is suitable for applying to this invention, as well as motor-shaft transmission by means of reducers or pulleys or direct transmission.

The fourth example of operating is also similar to the first where functioning is concerned, but with the difference that the eccentric shafts 2, 4, 11 and 13 which connect with the elements for applying the massage 5 and 14, are substituted by respective centred shafts 22 which also extend inwards into the interior instead of outwards, in such a way that the four centred shafts 22 face each other in twos.

Figure 8:
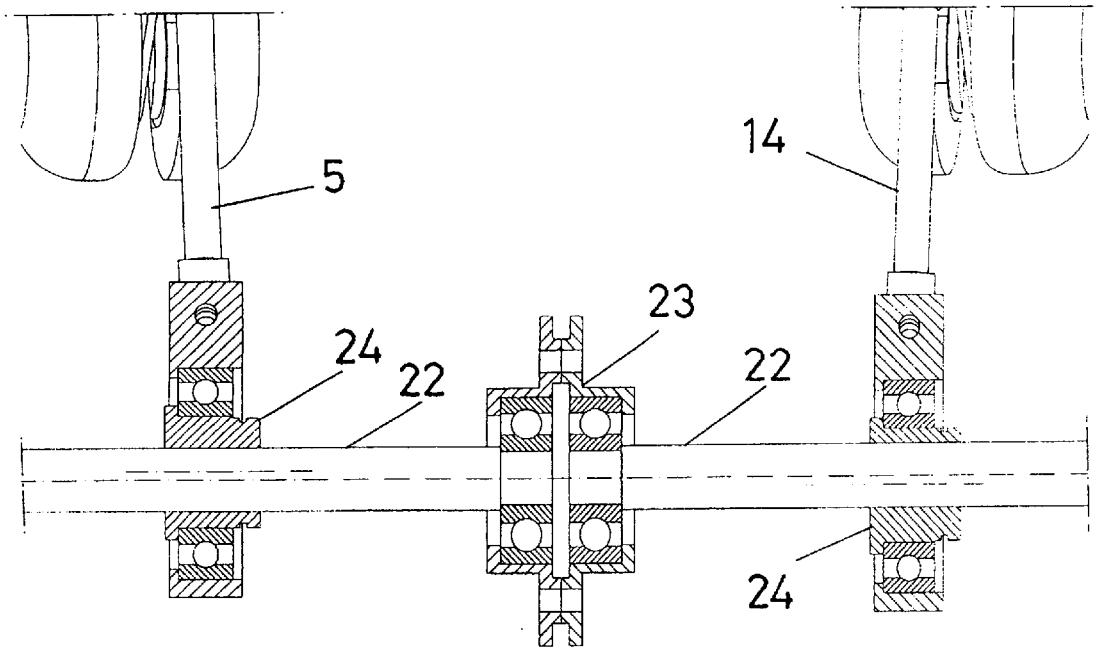
FIG. 8, shows a frontal, partial view in sections of another variation of the invention, in which the eccentric shafts of the motors are substituted by centred shafts, the necessary eccentricities being obtained by means of additional parts.
Figure 9:
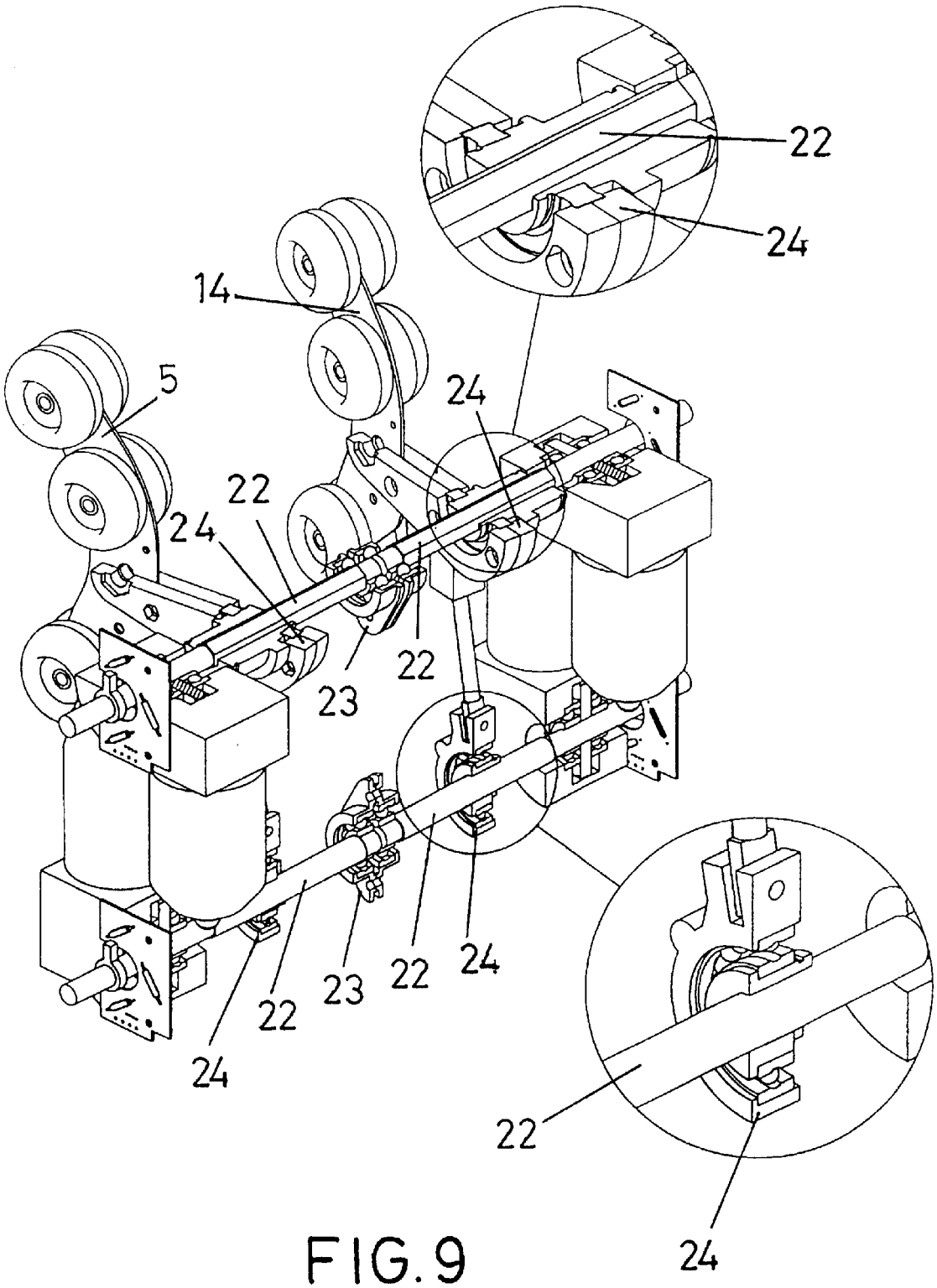
FIG. 9, shows a view in perspective and in sections, complete and with two details added to the variation of the invention referred to in the previous figure.
Figure 10:
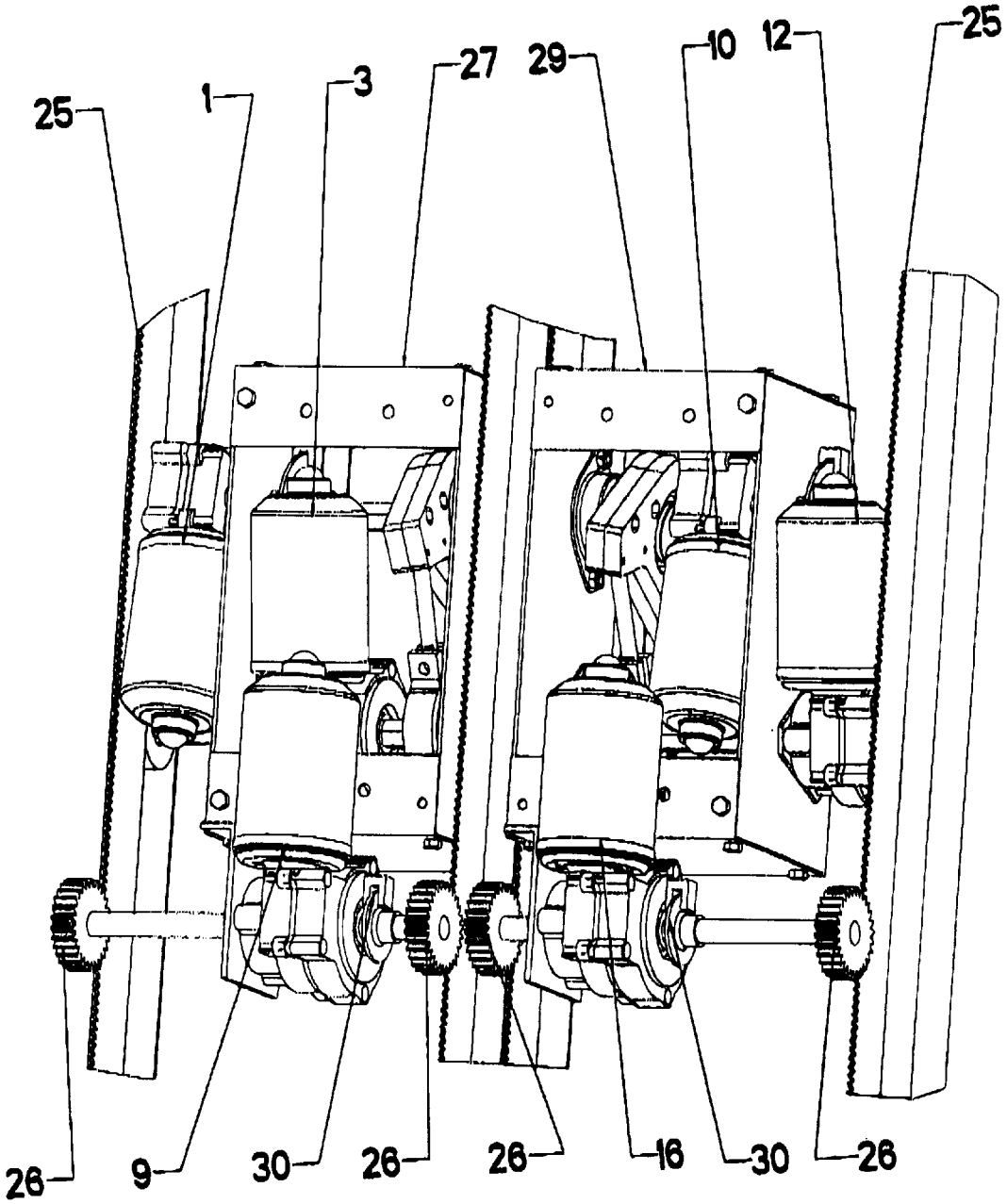
FIG. 10, shows a view of the invention in perspective, in which the vertical displacement of the massage motors is carried out by means of a rack and pinion wheel system, the displacement of the massage motors on the right side being independent of those on the left side.
Figure 11:
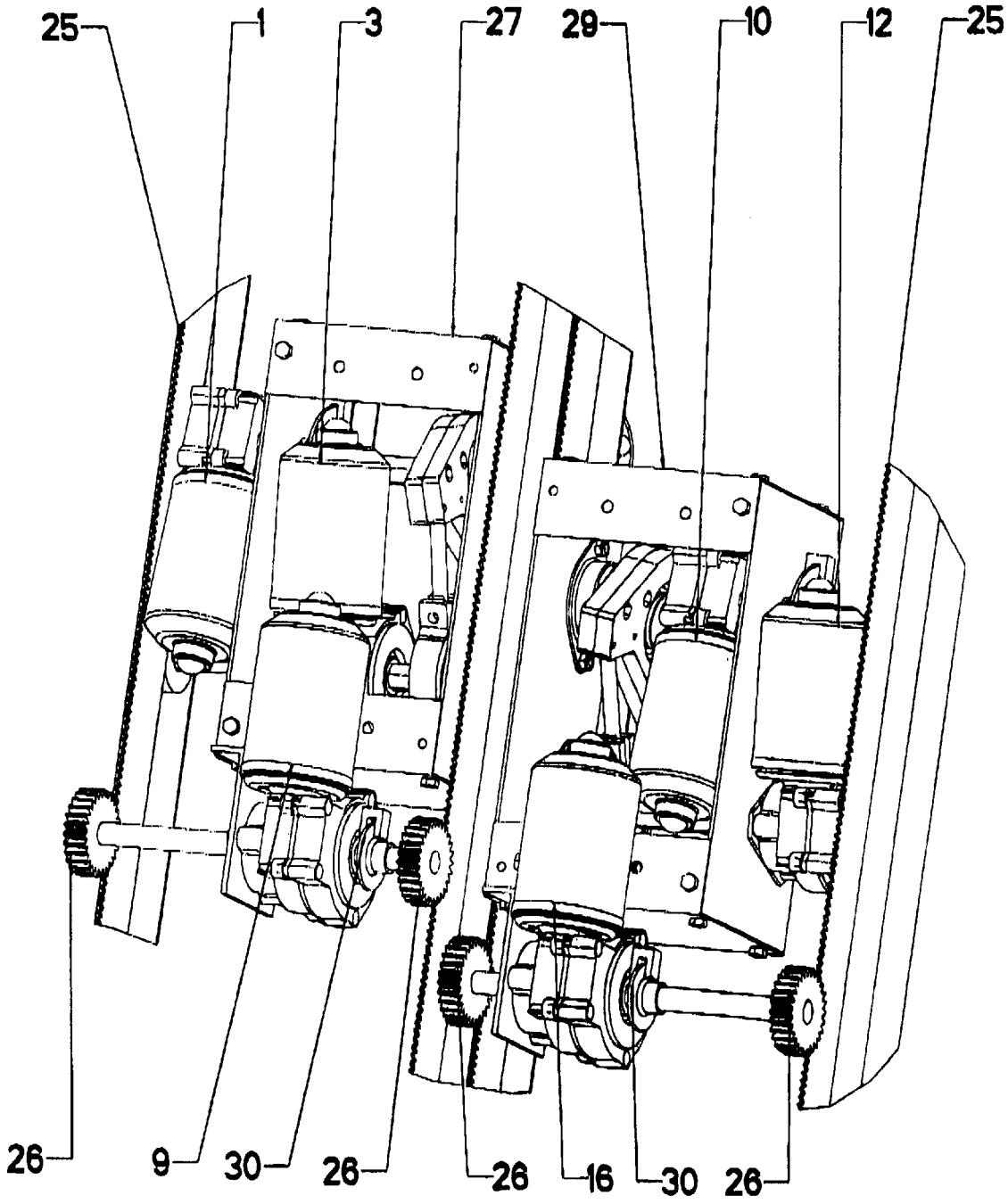
FIG. 11, shows a view of the invention referred to in FIG. 10 in perspective, in which the two blocks of left and right motors are shown at different heights.
Figure 12:
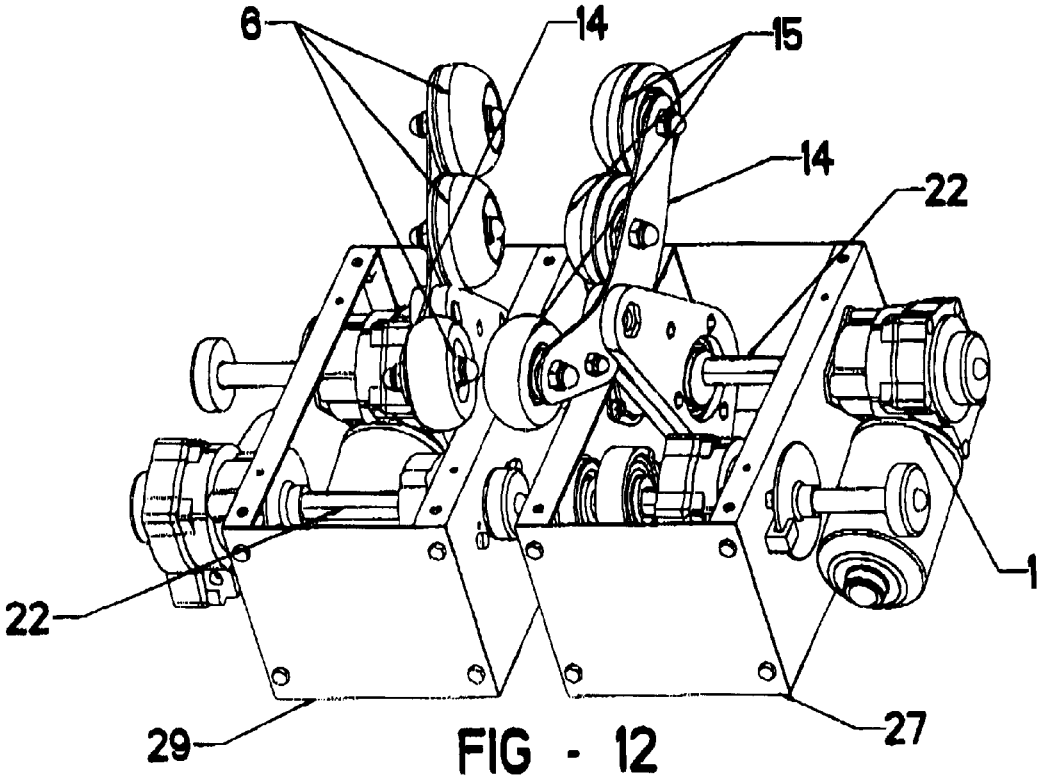
FIG. 12, shows a view of the two structures that house the right and left motors independently in perspective, with all their components.
Figure 13:
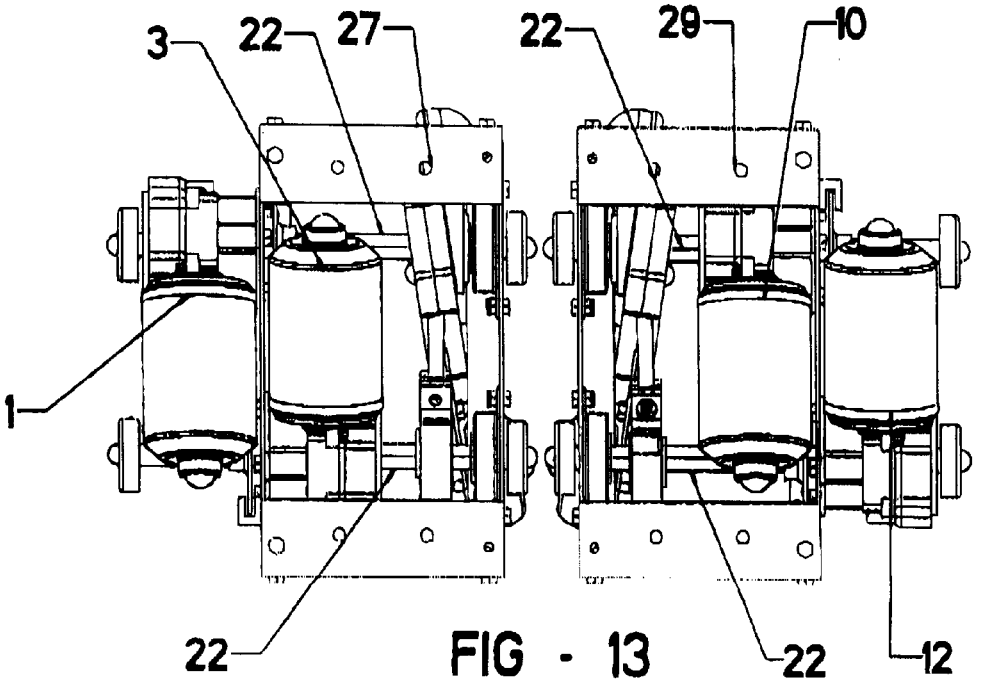
FIG. 13, shows a later front view of the invention in FIG. 12.
Figure 14:
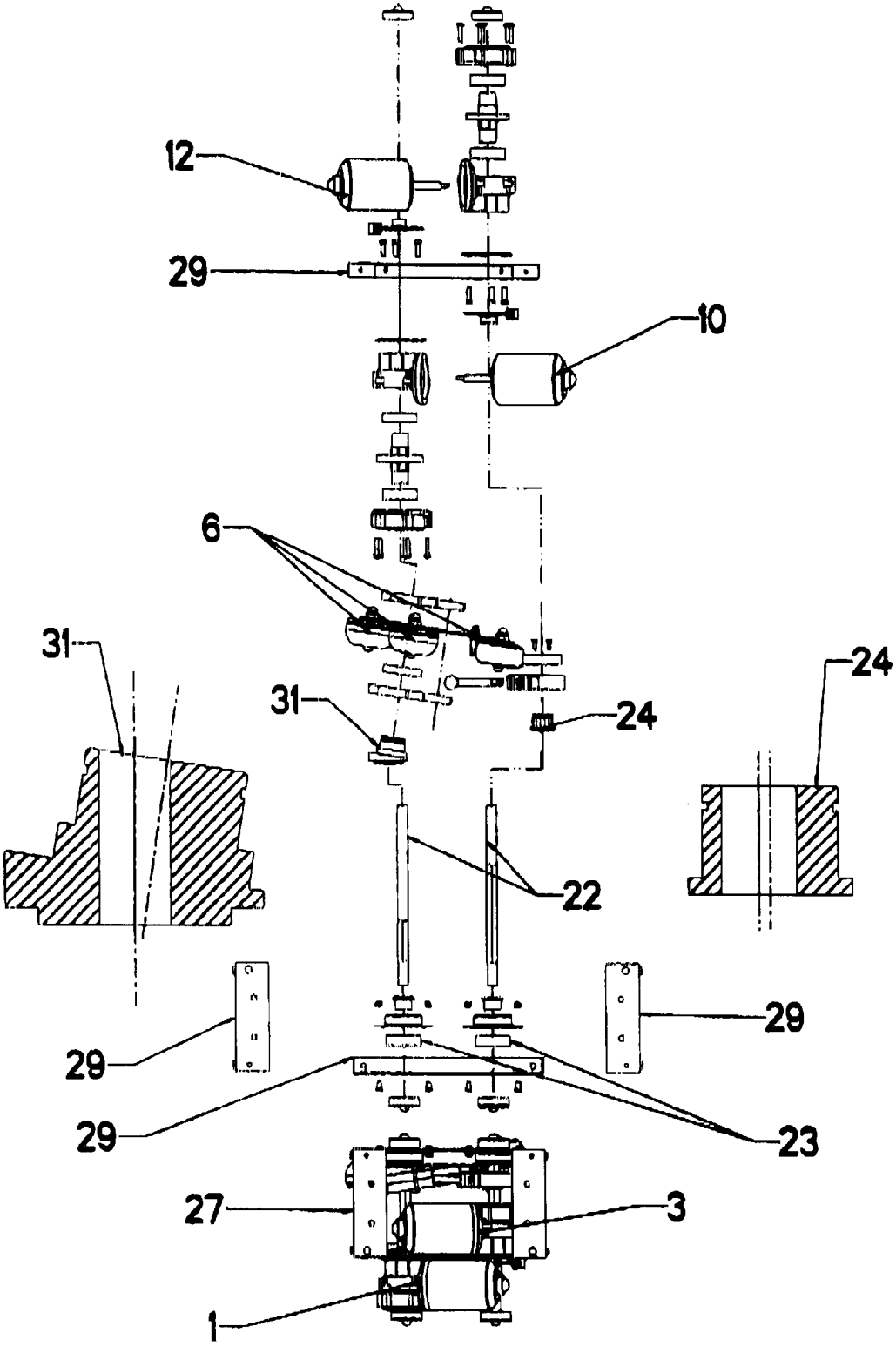
FIG. 14, shows a breakdown of the invention shown in FIGS. 12 and 13 where the bushes that cause the eccentric movement of the elements that apply the massage can be seen in detail.
Figure 15:
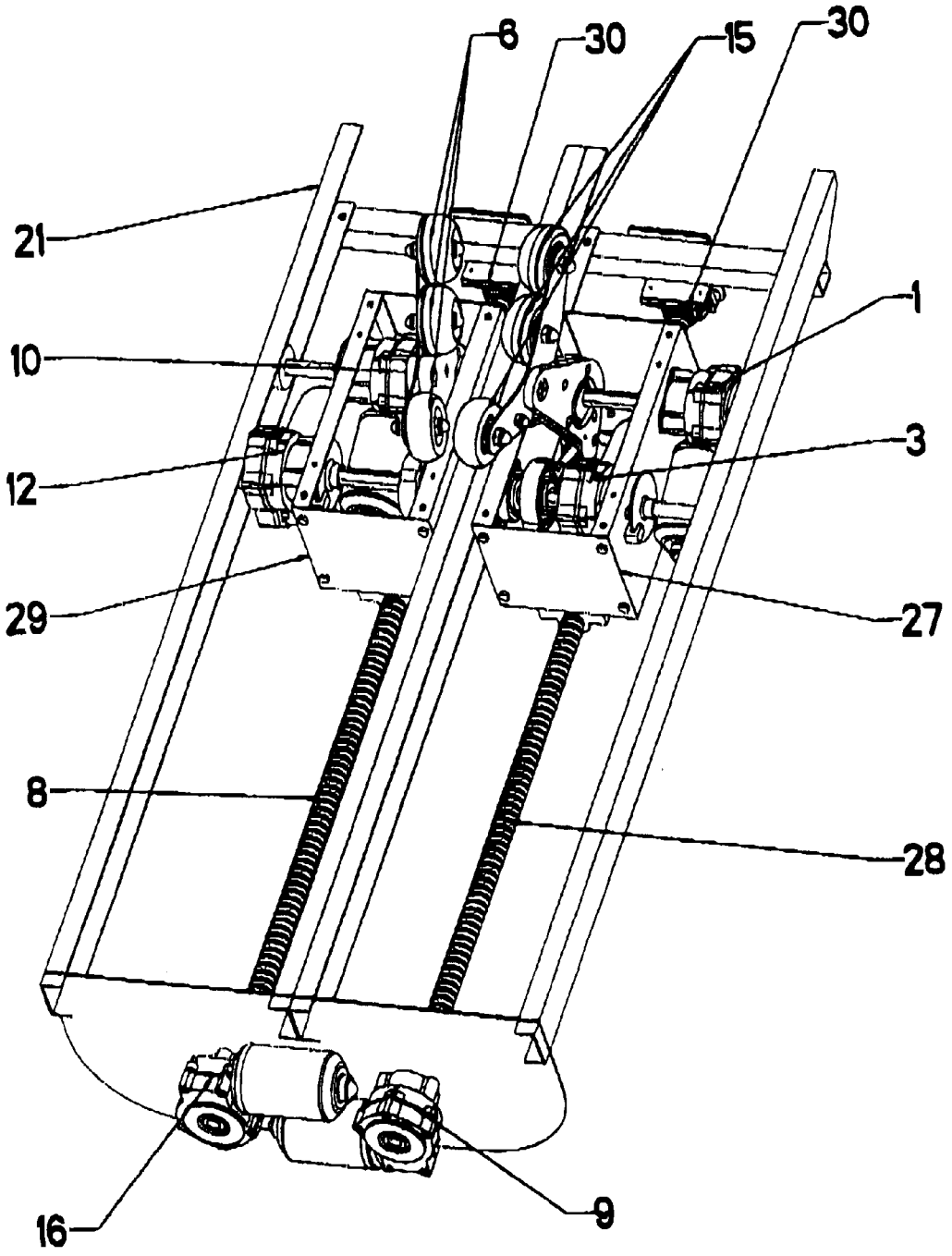
FIG. 15, shows a view of the device that is the object of this invention in perspective, in which two spindles are used for the vertical displacement of the massage motors, those on the right side being independent of those on the left side.
Figure 16:
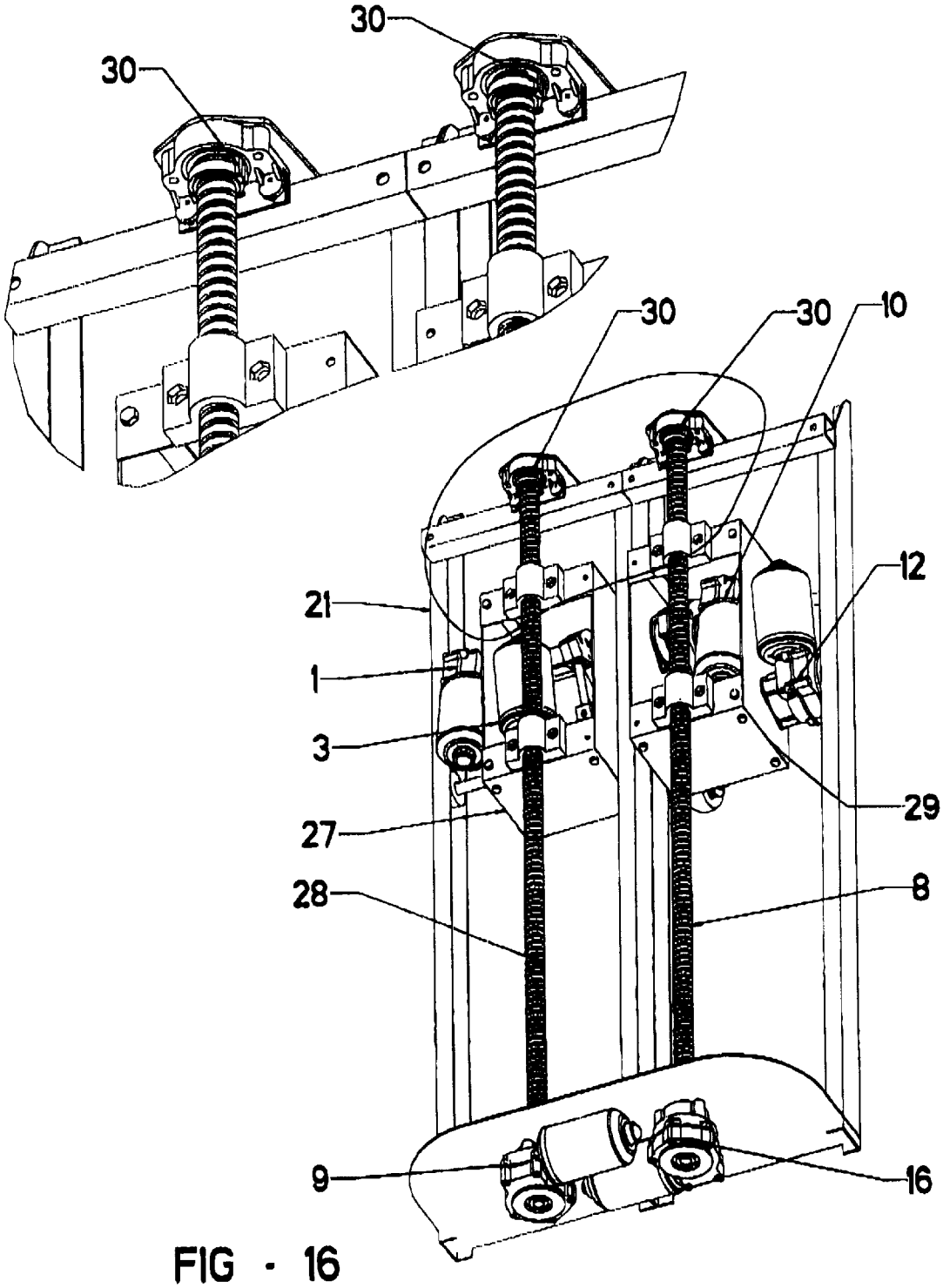
FIG. 16, shows a later view of the previous figure with an enlarged detail in which the vertical positioning sensors can be seen.
Figure 17:
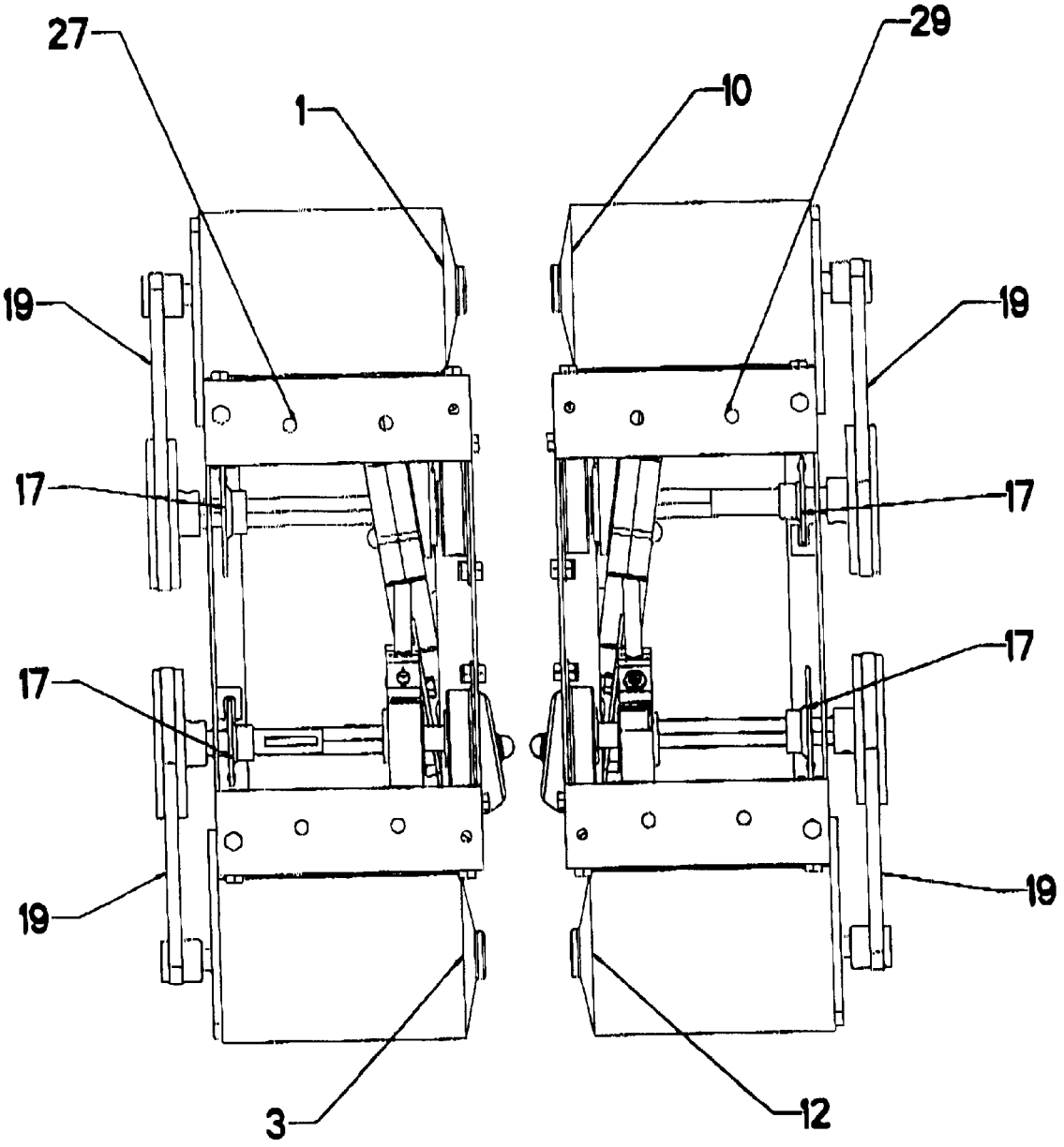
FIG. 17, shows a later view of the two structures that house the right and left motors independently, with all their components, in which the transmission of the motors to the centred shafts is performed via belts and pulleys.
Figure 18:
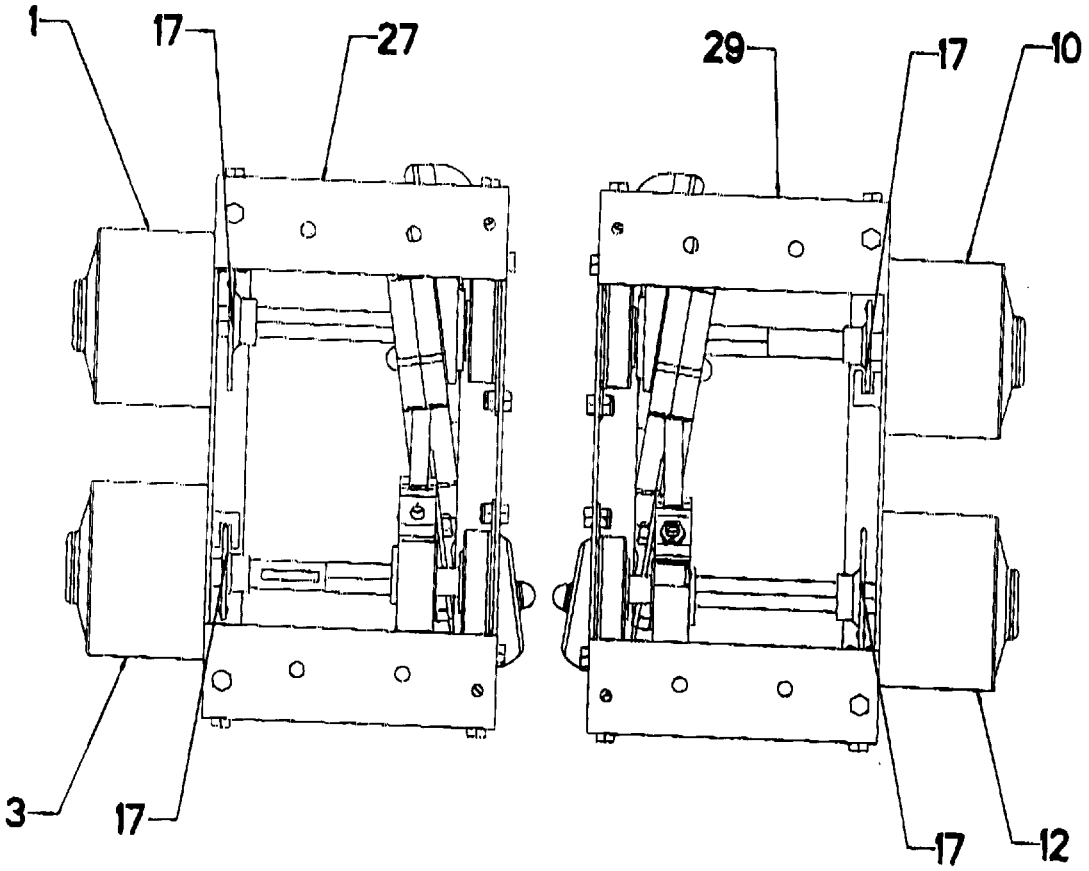
FIG. 18, shows another later view of the two structures that house the right and left motors independently, with all their components, in which the transmission of the motors to the centred shafts is performed directly by the rotors of the motors to the massage shafts.

Each facing pair of centred shafts 22 have a central support bearing 23 which connects with these two shafts 22, in such a way that these two shafts 22 give mutual support but their turning movements remain independent, as shown in FIG. 8.

Finally, an eccentric transmission device (24, 31) is located on each of the four centred shafts 22 which is connected to the corresponding element for applying the massage 5 or 14.

With this configuration, this fourth example shows all the advantages and uses of the first example but with the added advantage that its components have less mechanical suffering as they do not suffer from the vibrations corresponding to the eccentric elements of the rotors of the motors.

The fifth example of operating is identical to the one above but with the difference that the vertical displacement of the structures which house the motors two by two (27, 29) is independent and governed by two motors, one right 9 and one left 16, there being no two by two facing each other as in the previous example. In this example a joint rack 25 and pinion 26 wheel is used for the vertical displacement for each massage side, left and right, the vertical displacement motors (9, 16) being connected to the structures that house the massage motors (27,29).

The sixth example of operating is identical to the one above but this vertical displacement system is composed of spindles (8, 28) governed by the vertical displacement motors (9, 16) whose task is to displace the structures 27 and 29 vertically.

What is claimed is:

1. MASSAGE DEVICE FOR A REST ARMCHAIR, including means for applying kneading and tapping massage to a user's back, characterised in that the device includes:

a left-hand kneading motor arranged to transmit rotation to a first shaft;

a right-hand kneading motor arranged to transmit rotation to a second shaft;

a left-hand tapping motor arranged to transmit rotation to a third shaft;

a right-hand tapping motor arranged to transmit rotation to fourth shaft;

wherein the first shaft and the third shaft are connected to a massage application element for the left-hand side of the user's back, whereas the second shaft and the fourth shaft are coupled to a massage application element for the right-hand side of the user's back;

and wherein the motors are mutually independent, providing for:

independence between the massage applied to the left-hand side of the user's back and the massage applied to the right-hand side of the user's back, for kneading as well as for tapping, allowing for regulation of the intensity or speed on each side in an independent manner;

possibility of choosing between synchronisation or unsynchronisation between the massages applied to the left-hand and the right-hand side of the user's back;

possibility of variation in the direction of the kneading massage on he left-hand side of the user's back and variation in the direction of the kneading massage on the right-hand side of the user's back, in a mutually independent manner.

2. MASSAGE DEVICE FOR A REST ARMCHAIR, in accordance with claim 1, characterised in that said device further includes:

a control unit connected to the four motors; and a number of sensors of the angular position of said first, second, third and fourth shafts, said sensors being connected to a microprocessor connected to said control unit, allowing for:

multiple choice of lateral positioning of wheels of the massage application elements for vertical massaging, in an independent manner for the left-hand and right-hand regions of the users back, and multiple choice of depth positioning of wheels of the massage application elements, in order to adjust pressure for vertical massaging, in a independent manner for the left-hand and right-hand regions of the users back.

3. MASSAGE DEVICE FOR A REST ARMCHAIR, in accordance with claim 2, characterised in that to the control unit is also connected a left-hand displacement motor which enables joint vertical displacement of the motors for left-hand kneading massage and left-hand tapping massage.

4. MASSAGE DEVICE FOR A REST ARMCHAIR, in accordance with claim 2, characterised in that the four motors are fixed in a common casing, whereby the device includes a single vertical displacement motor for vertical displacement of said common casing said vertical displacement motor being connected with the control unit.

5. MASSAGE DEVICE FOR A REST ARMCHAIR, in accordance with claim 4, characterised in that by means of a spindle said vertical displacement motor displaces said common casing.

6. MASSAGE DEVICE FOR A REST ARMCHAIR, in accordance with claim 3, characterised in that by means of a spindle said left-hand displacement motor displaces the motors for left-hand kneading massage and left hand tapping massage.

7. MASSAGE DEVICE FOR A REST ARMCHAIR, in accordance with claim 3, characterised in that to said control unit a right-hand displacement motor is connected which enables joint vertical displacement of the motors for right-hand kneading massage and right-hand tapping massage.

8. MASSAGE DEVICE FOR A REST ARMCHAIR, in accordance with claim 7, characterised in that by means of a further spindle said right-hand displacement motor displaces the motors for right-hand kneading massage and right-hand tapping massage.

9. MASSAGE DEVICE FOR A REST ARMCHAIR, in accordance with claim 1, characterised in that said four shafts are four centred shafts which project towards the inside and which are facing each other two by two; there being between each pair of centred facing shafts a support bearing which connects to the shafts of the corresponding pair, whereby said two shafts provide each other with mutual support maintaining their rotational motions independent; and an eccentric transmission device is located on each of the four centre shafts, which eccentric transmission device is connected to the corresponding massage application element.

10. MESSAGE DEVICE FOR A REST ARMCHAIR, in accordance with claim 1, characterised in that said four shafts comprise one left-hand, inclined and eccentric shaft, one right-hand, inclined and eccentric shaft, one left-hand eccentric shaft and one right-hand eccentric shaft; these shafts being connected respectively to the left-hand kneading massaging motor, the right-hand kneading massaging motor, the left-hand tapping massaging motor and the right-hand tapping massaging motor.

11. MASSAGE DEVICE FOR A REST ARMCHAIR, in accordance with claim 10, characterised in that transmission of rotation from the motors to the shafts is arranged to take place through reducing gears.

12. MASSAGE DEVICE FOR A REST ARMCHAIR, in accordance with claim 10, characterised in that transmission of rotation from the motors to the shafts is arranged to take place through pulleys and belts.

13. MASSAGE DEVICE FOR A REST ARMCHAIR, in accordance with claim 10, characterised in that transmission of rotation from the motors to the shafts is arranged to take place directly by means of the rotors of said motors.

* * * * *